US009539732B2

(12) United States Patent
Segler et al.

(10) Patent No.: US 9,539,732 B2
(45) Date of Patent: Jan. 10, 2017

(54) CUTTING TOOL WITH INTERCHANGEABLE BLADE AND METHOD FOR REPLACING AN AC-BLADE

(71) Applicant: Martor KG, Soliingen (DE)

(72) Inventors: Florian Segler, Solingen (DE); Martin Rohrbach, Horn (DE)

(73) Assignee: Martor KG, Solingen (DE)

( * ) Notice: Subject to any disclaimer, the term of this patent is extended or adjusted under 35 U.S.C. 154(b) by 240 days.

(21) Appl. No.: 14/143,392

(22) Filed: Dec. 30, 2013

(65) Prior Publication Data

US 2014/0190018 A1 Jul. 10, 2014

(30) Foreign Application Priority Data

Jan. 4, 2013 (DE) ..... 10 2013 200 061

(51) Int. Cl.
*B26B 5/00* (2006.01)
*B26B 9/00* (2006.01)

(52) U.S. Cl.
CPC ..... *B26B 5/00* (2013.01); *B26B 5/005* (2013.01); *B26B 9/00* (2013.01); *Y10T 29/4973* (2015.01)

(58) Field of Classification Search
CPC ..... B26B 5/00; B26B 5/005; B26B 9/00; Y10T 29/4973
USPC ..... 30/280, 339
See application file for complete search history.

(56) References Cited

U.S. PATENT DOCUMENTS 1,361,021 A * 12/1920 Copeman ..... B25F 1/02 279/77
1,813,723 A * 7/1931 Beaver ..... B26B 5/00 279/77
1,998,188 A * 4/1935 Dunn ..... B26B 5/00 261/114.1
2,439,071 A 4/1948 Basham
3,121,952 A * 2/1964 Schohl ..... B26B 5/00 30/331
3,845,554 A * 11/1974 Joanis ..... B26B 5/00 30/125

(Continued)

FOREIGN PATENT DOCUMENTS

DE 69101415 T2 8/1994
DE 10136019 C1 12/2002

(Continued)

OTHER PUBLICATIONS

German Patent Office, Official Action issued in German application No. 10 2013 200 061.8 dated Oct. 14, 2013.

(Continued)

*Primary Examiner* — Hwei C Payer

(74) *Attorney, Agent, or Firm* — Wood Herron & Evans LLP

(57) ABSTRACT

A cutting tool (1), and a method of exchanging an interchangeable blade as well as a cutting tool housing, in particular for severing flat and/or strand-form materials. The cutting tool (1) includes a housing (2), at least one interchangeable blade (8) arranged at a holding portion (6) of the housing (2), and a locking member (40) arranged movably on the housing (2) for locking the blade (8) to the housing (2). The housing (2) has first positively locking elements (23, 24, 26, 28) and the locking member (40) has second positively locking elements (42) which jointly lock the blade (8) in a given position to the housing (2).

8 Claims, 5 Drawing Sheets

(56) References Cited

U.S. PATENT DOCUMENTS

| | | | | | |
|---|---|---|---|---|---|
| 3,900,950 | A * | 8/1975 | Collins | B26B 5/00 | 30/331 |
| 4,011,657 | A * | 3/1977 | Vance | B26B 5/00 | 279/77 |
| 4,169,312 | A * | 10/1979 | Mar | B26B 5/00 | 30/331 |
| 4,261,104 | A | 4/1981 | Cuscovitch | | |
| 4,391,043 | A * | 7/1983 | Sizemore | B25G 3/18 | 30/330 |
| 4,524,518 | A | 6/1985 | West | | |
| 5,168,630 | A * | 12/1992 | Weber | B26B 5/00 | 30/125 |
| 5,404,645 | A | 4/1995 | Janser | | |
| 7,134,207 | B2 * | 11/2006 | Ping | B26B 5/00 | 30/125 |
| 8,782,909 | B1 * | 7/2014 | Davis | B26B 5/003 | 30/2 |
| D714,611 | S * | 10/2014 | Yu Chen | D8/98 | |
| 2004/0143924 | A1 | 7/2004 | Salmon | | |
| 2014/0190018 | A1 * | 7/2014 | Segler | B26B 5/00 | 30/278 |

FOREIGN PATENT DOCUMENTS

| | | | |
|---|---|---|---|
| DE | 10 2013 200 061 | A1 * | 7/2014 |
| EP | 0451544 | A2 | 10/1991 |
| EP | 0469959 | A1 | 2/1992 |
| EP | 2 752 276 | A1 * | 12/2013 |
| GB | 1413679 | A | 11/1975 |

OTHER PUBLICATIONS

European Patent Office, Search Report issued in application No. 13198200.1 dated Apr. 8, 2014.

* cited by examiner

CUTTING TOOL WITH INTERCHANGEABLE BLADE AND METHOD FOR REPLACING AN AC-BLADE

BACKGROUND

The invention concerns a cutting tool, in particular for severing flat and/or strand-form materials. The invention further concerns an interchangeable blade in particular for use in a cutting tool of the foregoing kind as well as a cutting tool housing, in particular for use on a cutting tool of the foregoing kind. The invention further concerns a method of changing an interchangeable blade.

Cutting tools of that kind generally have a housing and a blade which is replaceable. The housing serves, on the one hand, to hold the blade and, on the other hand, to grip the cutting tool so that it can be guided with the hand. In principle a distinction can be drawn between two different kinds of cutting tool with interchangeable blades, more specifically on the one hand cutting tools with strip steel blades which for resharpening or resetting have a strip steel blade having a plurality of segments. The blade can be pushed out of the housing and, at the front thereof, individual segments which have become blunt can be separated off so that a sharp blade for cutting purposes is always available. On the other hand, there are also cutting tools which have a non-segmented blade which is replaceable as a whole. Such a cutting tool is disclosed for example in International patent application WO 2012/019589 A2 to the present applicant.

A disadvantage with cutting tools in which only the blade is replaceable as a whole is that the replacement operation is generally time-consuming and can only be performed with the aid of a tool like, for example, a screwdriver.

SUMMARY

Therefore, the object of the present invention is to provide a cutting tool of the kind set forth in the opening part of this specification as well as an interchangeable blade, a cutting tool housing and a method of the kind set forth in the opening part of this specification, by means of which replacement of an interchangeable blade is substantially simplified, and in particular can be carried out in a shorter time and without an additional tool.

The object of the invention is attained by a cutting tool having a housing and at least one interchangeable blade which is arranged at a holding portion of the housing, and the cutting tool has a locking member arranged moveably on the housing for locking the blade to the housing, wherein the housing has first positively locking elements and the locking member has second positively locking elements which jointly lock the blade in a given position on the housing. For that purpose, the housing has preferably at a front end a holding portion at which the blade is held and locked by means of the locking member and a rear gripping region at which the cutting tool can be gripped and guided by a user. When the blade is locked, it is locked or fixed in a given position on the housing and, accordingly, cannot be removed. If, in contrast, the blade is not locked by the locking member, the blade can be removed and can thus be replaced by a fresh blade.

Preferably, the locking member is arranged at or in the housing in such a way that it is actuable by a user from outside the housing.

That substantially simplifies replacing an interchangeable blade. There is no need for a screwing-on operation or the like in respect of the housing, but rather the locking member is only to be moved relative to the housing in such a way that it does not lock the interchangeable blade and the interchangeable blade is removable. A fresh blade can then be arranged and the locking member can in turn be moved relative to the housing so that it locks the blade in a given position to the housing. That substantially simplifies changing the interchangeable blade, which is possible in a shorter time and also more safely.

In a first preferred embodiment, the locking member is reciprocatingly movable between a first position in which the blade is locked and a second position in which the blade is released. Particularly preferably, the locking member is mounted pivotably to the housing. Thus, the blade can be released or locked by pivoting the locking member. Alternatively, the locking member is reciprocatingly movable with a translatory movement between the positions on a straight path of movement. Other paths of movement can also be advantageous and preferred. If the locking member is arranged pivotably between the first and second positions, then actuation of the locking member on the one hand is particularly simple, while on the other hand that also substantially prevents unwanted actuation.

In a further preferred embodiment, the locking member is arranged on a rotational lever mounted pivotably to the housing. That provides on the one hand that the locking member can be particularly easily actuated while on the other hand only a low force is to be applied to the rotational lever by the user to move the locking member into the first position and to move it out of that position into the second position to lock or release the blade. That further simplifies operation. Insofar as it is possible with the locking member to apply to the interchangeable blade a force which is greater in comparison with actuation, this arrangement also provides that the interchangeable blade is securely held to the housing. That also improves the safety aspect of the entire cutting tool.

In that respect, it is preferred that the rotational lever is arranged in the first position substantially within the housing. As a result, it forms substantially one unit from the outside with the housing and preferably does not project from the housing which would be a nuisance. Preferably, the rotational lever is pivoted out of the housing in the second position of the locking member and is sunk substantially in the housing in the first position. In that way, a user can also always easily sense by visual means and by touch, the position in which the locking member is disposed and can thus ascertain whether the blade is locked or released.

In a preferred development, provided on the rotational lever is a blade storage means for receiving at least one substitute blade. Particularly preferably, the substitute blade can be removed from the blade storage means in the second position of the rotational lever. That makes replacement of the interchangeable blade even easier. When the rotational lever is in the second position, the locking member is also in the second position and the interchangeable blade is not locked and can accordingly be removed. The user can now easily remove the fresh blade from the blade storage means and arrange it on the cutting tool in such a way that it is again lockable by means of the locking member by the rotational lever being pivoted into the first position. The replaced blade can, for example, be disposed of or can be inserted into the blade storage means by the user. That also improves the safety aspect as the arrangement affords a safe place for stowing the replaced blades and they do not have to be put, for example, into a trouser pocket or the like.

It is further preferred that the rotational lever has a snap hook and the housing has a holding slot into which a nose of the snap hook engages in the first position of the rotational lever to arrest same relative to the housing. The rotational lever cannot be released readily, that is to say only intentionally, from the housing, and pivoted. In addition, arresting the rotational lever in position by means of a snap hook is a particularly simple arresting option whereby replacement of the blade is further simplified. That also further improves and simplifies the construction and the production of the cutting tool.

In a further preferred embodiment, the blade has a blade head having a cutting edge and a blade foot, wherein provided at the blade foot are positively locking elements for positively lockingly cooperating with the positively locking elements of the housing and the locking member. In that way, the blade can be particularly well locked to the housing by means of the locking member and the cutting edge is free and is overall available for the cutting operation.

Preferably, the locking member as the positively locking element has at least one nose which engages into an opening on the blade for locking the blade. In particular, the nose of the locking member engages into an opening on the blade foot or into an opening between the blade head and the blade foot. It is further preferred that the housing as the positively locking element has at least one projection which engages into an opening on the blade. In particular the projection on the housing engages into an opening at the blade foot or into an opening between the blade head and the blade foot. In that way, the blade can be positively arrested to the housing or the locking member in a particularly simple fashion, and locked by means of the locking member.

In a preferred development in that case, the two openings at the blade foot are arranged in mutually opposite relationship and jointly define a hammerhead-like region, that can be engaged behind, of the blade. Because the two openings are arranged in mutually opposite relationship and jointly define a region which can be engaged behind and which is preferably of a waisted configuration, the blade can be particularly effectively arrested on the housing and locked by means of the locking member. On the one hand, that improves the safety aspect, while on the other hand replacement is also simplified.

In a further preferred embodiment, the blade has a flat abutment which bears against a corresponding abutment on the housing so that cutting reaction forces are transmitted into the housing. That further improves the safety aspect of the cutting tool. In the cutting operation, high cutting reaction forces can sometimes occur, which have to be absorbed in the housing and which then have to be counter-supported by the user. If the cutting reaction forces act on the blade in that way, it is preferable for them to be transmitted into the housing by way of the flat abutment and the corresponding abutment on the housing so that not all cutting reaction forces have to be carried by the positively locking elements of the housing and the locking member. That also further simplifies the structure.

In a further preferred development, the positively locking elements of the blade cooperate with the positively locking elements of the housing and the locking member in such a way that substantially no moments are introduced into the rotational lever by virtue of cutting reaction forces. Preferably, no moments which force the rotational lever into the second position are applied thereto. It can however be preferred for moments to be applied to the rotational lever, which urge it into or hold it in the first position. That further improves the safety aspect of the cutting tool. Unintentional release of the locking member and thus release of the blade by virtue of cutting reaction forces are prevented.

In a further preferred embodiment of the cutting tool, the cutting edge is oriented substantially perpendicularly to a longitudinal axis of the cutting tool. Preferably in that case, the cutting edge faces rearwardly, that is to say in the direction of the gripping region of the housing. By means of such an orientation of the blade or the cutting edge, the cutting tool is suitable for particularly well severing flat materials. For example, the cutting tool is to be applied to a distal end, as viewed by the user, of a material to be cut, and is then to be pulled in the direction of the user towards the proximal end of the material in order to completely sever it. The present invention can be particularly advantageously used with such cutting edge orientations as, with such a blade orientation, the use of strip steel blades with separable segments is only limitedly possible.

Preferably, the blade head has a holding portion for engaging into the housing and a guide portion for guiding material to be severed, wherein the cutting edge is arranged between said two portions. In that way, material to be severed is guided by that guide portion towards the cutting edge so that severing of the material is even more easily possible. That further simplifies handling of the cutting tool.

Preferably, the guide portion is substantially skid-shaped. Preferably, the skid-shaped guide portion is of a rounded-off or beak-shaped configuration. In that way, the material to be severed can particularly well slide on the guide portion and be guided towards the cutting edge. For that purpose, preferably, the guide portion has a substantially bend-free guide surface. In that way, the material to be severed is further treated carefully and it is possible to achieve a clean cut.

It is further preferred that the guide portion and the housing and/or the holding portion jointly form a guide passage for feeding the material to be severed to the cutting edge. Preferably, the guide passage enlarges away from the cutting edge. In that way, the material to be severed is even better guided on to the cutting edge whereby a clean severing cut and safe operation are possible. The fact that the guide passage is defined, on the one hand, by the housing and, on the other hand, by the guide portion of the blade means that a width of the guide passage can be suitably adjusted by replacement of the blade by a blade of another geometry. Thus, the cutting tool can be easily adapted to different cutting situations like, for example, different material thicknesses of material to be severed.

In a further aspect in an interchangeable blade of the kind set forth in the opening part of this specification, in particular for use in a cutting tool according to one of the above-described preferred embodiments, the invention attains the above-stated object in that the interchangeable blade has a blade head which has a holding portion for engagement into a housing of a cutting tool and a cutting edge, and also a blade foot which is in the form of a hammerhead-like projection and defines two openings on the blade for positively lockingly cooperating with a housing of a cutting tool and/or a locking member of a cutting tool. Such an interchangeable blade can be easily arranged on the cutting tool as also already described hereinbefore in connection with the cutting tool, and locked to the housing by means of the locking member. Handling of the cutting tool and replacement of the blade are substantially simplified and more safely possible. It is to be appreciated that the interchangeable blade as well as the cutting tool with the interchangeable blade have a large number of common aspects as are to be reflected in particular in appendant claims. In that respect, reference is directed in its full entirety to the foregoing description and the advantages of the cutting tool.

In a preferred development of the interchangeable blade, it has a guide portion for forming a guide passage together with the holding portion and/or a housing of a cutting tool, the cutting edge being arranged between the holding portion and the guide portion. The guide portion is accordingly provided on the interchangeable blade. When severing flat material, the guide portion generally bears against it and guides the material towards the cutting edge. In that way, the guide portion is subjected to a certain wear. Because the guide portion is arranged at the interchangeable blade and not the housing, it is replaced together with the interchangeable blade when the latter is blunt. That prolongs the service life of the cutting tool, in particular of the housing, and there is always an unworn guide portion, whereby a clean cut can be produced.

In a further aspect of the invention, the above-stated object is attained by a cutting tool housing of the kind stated in the opening part of this specification, in particular for use in a cutting tool according to one of the above-described preferred embodiments, comprising a holding portion for receiving an interchangeable blade, in particular an interchangeable blade according to one of the above-described preferred embodiments of an interchangeable blade, and a locking member arranged movably on the housing for locking the blade to the housing, wherein the housing has first positively locking elements and the locking member has second positively locking elements which jointly lock the blade in a given position in the housing. By means of such a cutting tool housing, replacement of blades is possible in a particularly simple fashion, as described in particular hereinbefore in connection with the cutting tool with an interchangeable blade. It is to be appreciated that the cutting tool housing and the cutting tool described in the opening part of this specification with interchangeable blade have a large number of common aspects as are reflected in particular in appendant claims. In that respect, attention is directed in its full entirety to the foregoing description and the advantages.

In a further aspect of the invention, the object set forth hereinbefore in regard to a method of changing an interchangeable blade of a cutting tool, in particular a cutting tool in accordance with one of the above-described preferred embodiments of a cutting tool is attained by the steps: moving a locking member into a second position to release an interchangeable blade; pulling the blade out of a housing of the cutting tool; inserting a fresh blade into the housing; and moving the locking member into a first position to lock the blade in a given position to the housing. Preferably, the movement of the locking member includes a rotation of the locking member, in particular a rotation of a rotational lever, the locking member being arranged on the rotational lever. In a further preferred development, the movement of the locking member includes a rotation of a blade storage means, the locking member being arranged on the blade storage means. It is to be appreciated that the method of changing an interchangeable blade has a large number of common aspect with the cutting tool described hereinbefore; in that respect attention is directed in its full entirety to the foregoing description and the advantages specified therein.

BRIEF DESCRIPTION OF THE SEVERAL VIEWS OF THE DRAWINGS

The invention is described in greater detail hereinafter by means of an embodiment by way of example with reference to the accompanying Figures.

DETAILED DESCRIPTION

Figure 1:
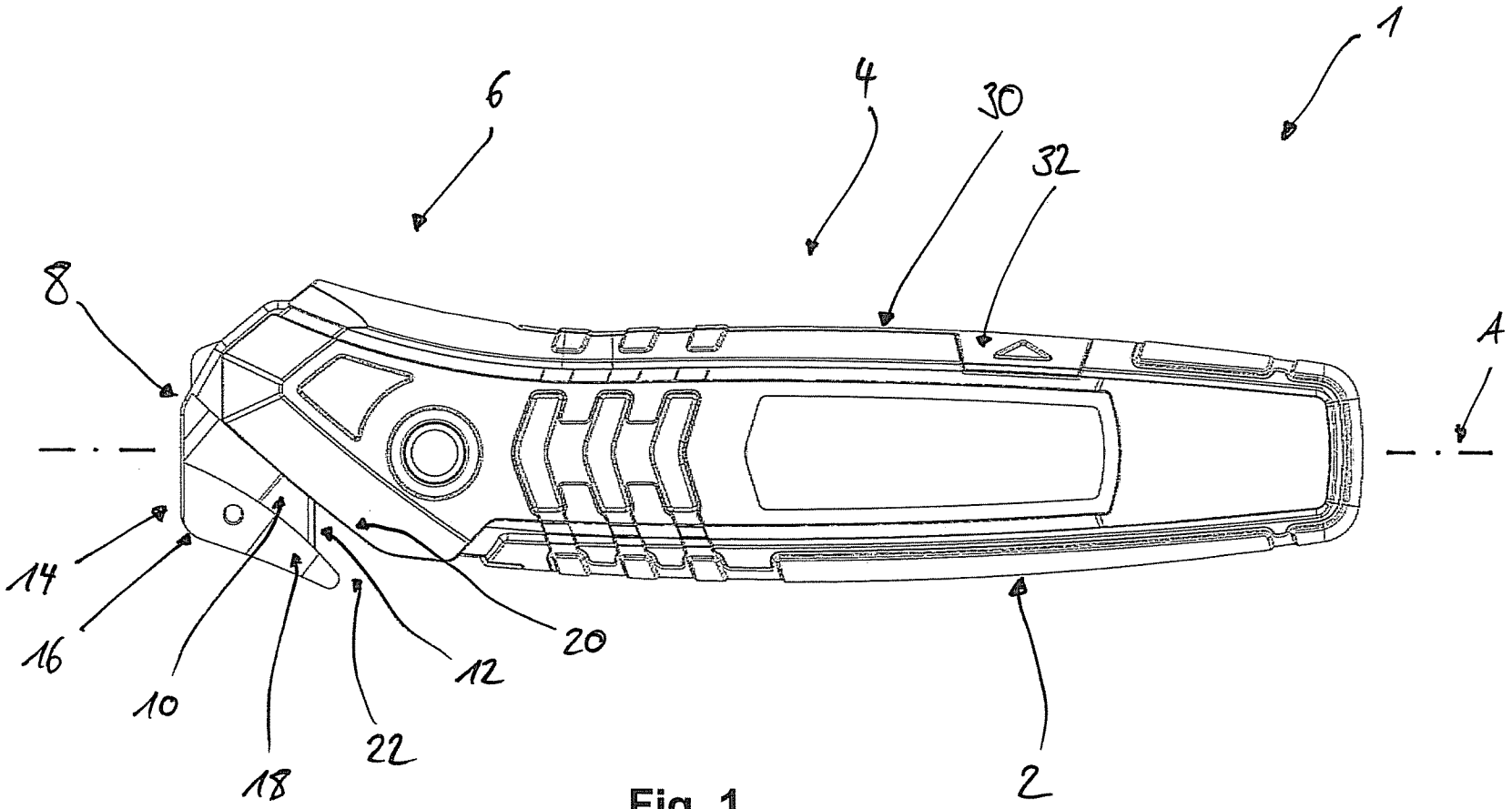
FIG. 1 shows a side view of a cutting tool in the condition of readiness for operation.

Referring to FIG. 1, a cutting tool 1 has a housing 2 which can comprise two mirror-symmetrical housing halves that are arranged against each other. The housing 2 has a gripping portion 4 at which a user can grip the cutting tool 1 and guide it for severing material, as well as a holding portion 6 at which an interchangeable blade 8 is arranged. The interchangeable blade 8 has a cutting part 10 with a cutting edge 12, which in this embodiment is oriented substantially perpendicularly to the longitudinal axis A of the cutting tool 1 and, more specifically, rearwardly, that is to say in the direction of the gripping portion 4. For severing flat material, therefore, the cutting tool 1 is to be guided with the longitudinal axis A substantially parallel to that material and is to be pulled, for example, from a distal end of a material to be severed, as viewed from the user, towards the proximal end of the material, in order to sever it.

The blade 8 has a blade head 14 that at least partially projects from the housing 2 at the holding portion 6. The cutting part 10 is at least partially engagingly fitted into a plastic body 16 in the region of the blade head 14. The cutting part 10 itself is preferably made from a blade steel. Because the cutting part 10 is fitted into the plastic body 16, outwardly projecting edges are enclosed, like in particular the blade tip of the cutting edge 12 which in this embodiment is engagingly fitted in a guide portion 18 of the blade, that is formed by the plastic body 16. That substantially reduces the risk of injury by the cutting tool 1 and improves safety. At the same time, the guide portion 18 together with a guide portion 20 of the housing 2 forms a guide passage 22 for feeding material to be severed to the cutting edge 12. Because the guide passage 22 is defined on the one hand by the guide portion 20 of the housing 2 and the guide portion 18 of the blade 8, a width of the guide passage 22 can be adjusted by exchanging the blade 8 for a blade with a longer cutting edge 12. In that way, the cutting tool 1 can be easily adapted to different cutting situations like for example different thicknesses of material to be severed.

In addition, FIG. 1 shows an upper edge of the rotational lever 30 at the upper end of the housing 2 and a gripping portion 32 for gripping and rotating the rotational lever 30. The gripping portion 32 is placed into the housing 2 in such a way as to project slightly thereon, and can be gripped and moved, for example, with a fingernail. Preferably, the gripping portion 32 is colored so that a user can easily see how the cutting tool 1 is to be operated.

Figure 2:
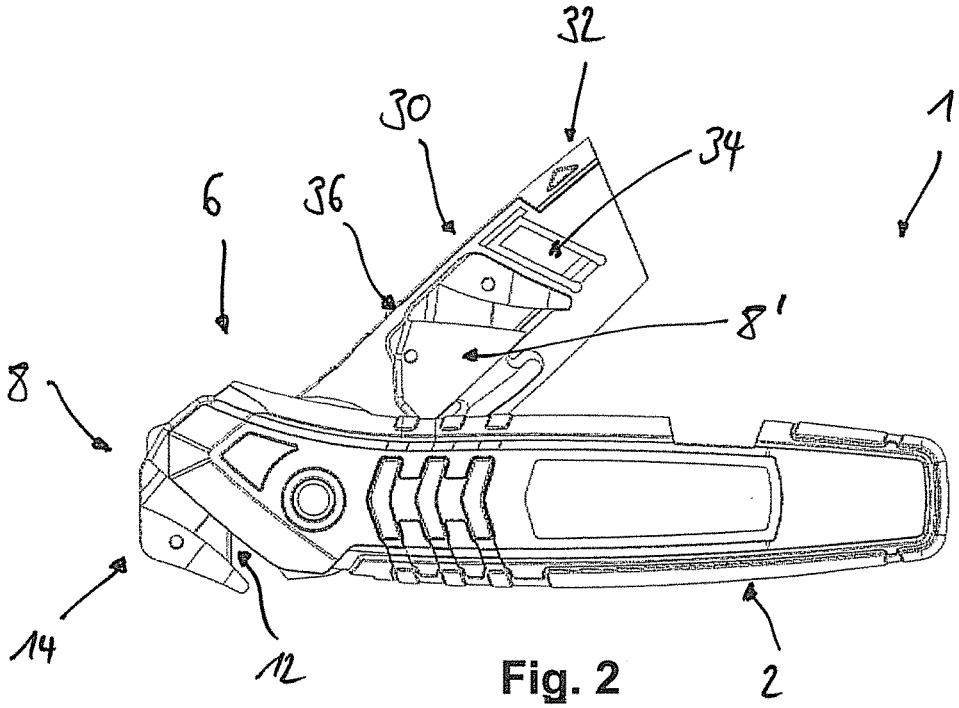
FIG. 2 shows a side view of the cutting tool with the rotational lever in the second position.
Figure 3:
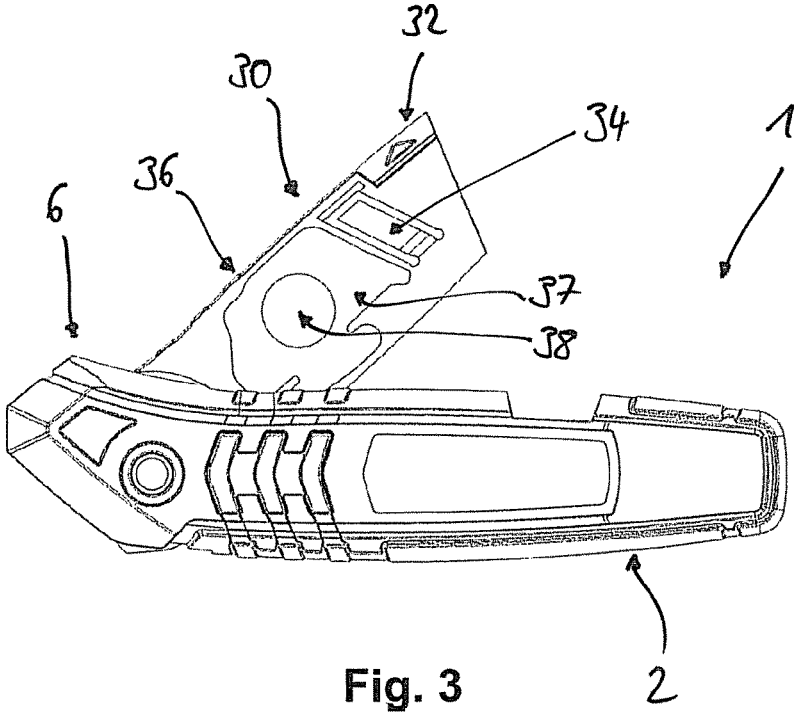
FIG. 3 shows a side view of the cutting tool with the rotational lever in the second position and the blade removed.

FIGS. 2 and 3 again show the cutting tool 1 as in FIG. 1, but with the rotational lever 30 in the second position, that is to say pivoted out of the housing 2.

The rotational lever 30 has a snap hook 34 by which the rotational lever 30 can be arrested to the housing 2. The rotational lever 30 also has a blade storage means 36 in which an interchangeable blade 8' is arranged (see FIG. 2). The blade storage means 36 is in the form of a recess 37 of a contour substantially corresponding to the external contour of a blade 8, 8'. In addition, arranged in the recess 37 is an aperture 38 so that the operator of the cutting tool 1 can push the interchangeable blade 8' arranged in the blade storage means 36 out of the recessed region 37, by its passing from the side of the rotational lever 30, that is opposite to the blade storage means 36, through the aperture 38, for example with a finger. As can be seen in particular from FIG. 3, the blade 8 can be removed from the holding portion 6 in the second position of the rotational lever 30. In the second position of the rotational lever 30, accordingly, the blade 8 is released and can be replaced.

FIG. 4 through 7 show the cutting tool 1 with the housing 2 opened, so that in particular the locking member 40 as well as the positively locking elements of the locking member 40 and of the housing 2 and thus the mode of operation of locking and release of the blade 8 can be seen. While in that respect the rotational lever 30 and thus also the locking member 40 are in the second position in FIGS. 4 and 5, the rotational lever 30 and the locking member 40 are in the first position in FIGS. 6 and 7 so that the blade is locked in a given position to the housing 2.

The rotational lever 30 has a mounting portion 31 (see in particular FIG. 4) with which the rotational lever 30 is mounted pivotably to the housing 2 at a pivot mounting 39. The pivot mounting 39 can include, for example, a cylindrical projection in the housing and the mounting portion 31 of the rotational lever 30 can have a cylindrical aperture so that the rotational lever 30 is mounted pivotably to the housing 2.

The rotational lever 30 is connected to the locking member 40 by way of the mounting portion 31. The locking member 40 is arranged on the rotational lever 30 at the end opposite to the gripping region 32 of the housing 2. In this embodiment, the locking member 40 has a nose 42 as the positively locking element 42. In the first position of the locking member 40 or the rotational lever 30 (see FIG. 6), the nose 42 engages into a corresponding opening 48 on the blade 8 or the blade foot 15.

Figure 4:
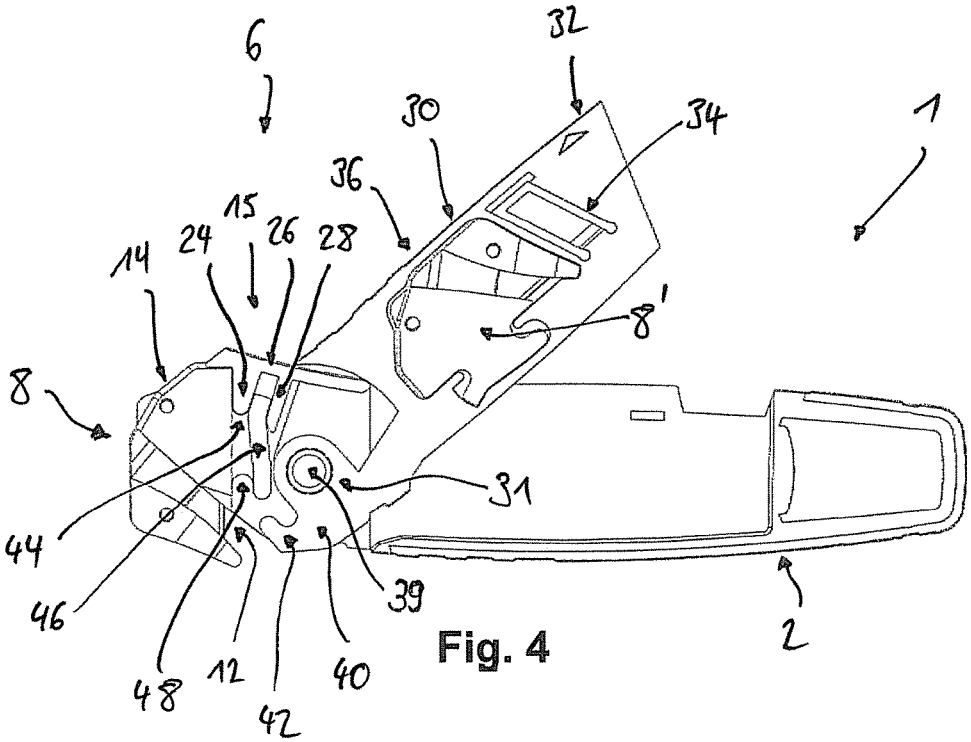
FIG. 4 shows a side view of the cutting tool with the rotational lever in the second position and the arranged blade and with the housing opened.
Figure 9:
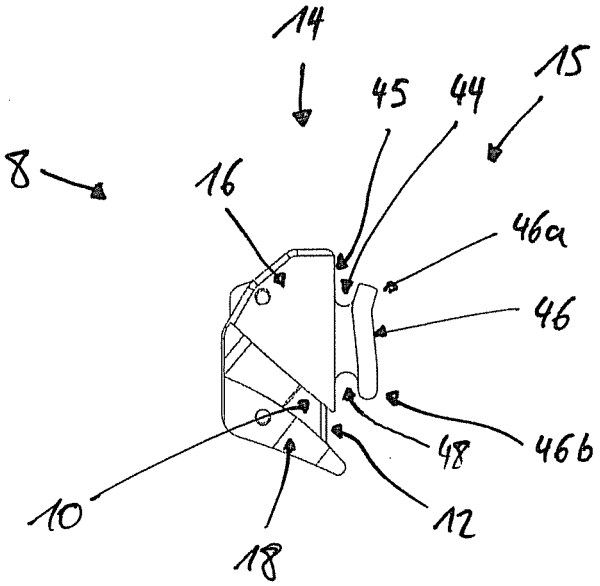
FIG. 9 shows a side view of the interchangeable blade.

Provided at the side of the holding portion 6 of the housing 2, that is in opposite relationship to the cutting edge 12, are a plurality of positively locking elements 23, 24, 26, 28. Reference 24 denotes a projection, reference 26 denotes a straight opening and reference 28 again denotes a projection which also forms an abutment for the blade foot 15. The projection 24 engages (as can be seen in FIG. 4) into a corresponding opening 44 at the blade foot 15. A hammer-head-like holding portion 46 which can be engaged behind is formed by the two oppositely disposed openings 44, 48 on the blade foot 15. The holding portion 46 has two oppositely disposed cantilever projection portions 46*a*, 46*b* (see FIG. 9). In this case, the projection portion 46*a* is substantially of a right-angled and straight and slightly angled configuration so that it can be inserted into the straight opening 26 on the housing 2. The straight opening 26 is defined by the projection 24 and the projection 28 on both sides. The projection portion 46*b* has the nose 42 engaging therebehind in the first position of the locking member 40 so that the blade 8 overall is locked in a given position relative to the housing 2. The abutment 23, which in this embodiment forms a right-angled wall on the housing 2, serves as an abutment for the flat abutment 45 (see FIG. 9) of the blade 8 and crucially carries the cutting reaction forces which act on the cutting edge 12. In addition, cutting reaction forces are applied to the nose 42 and thus the locking member 40 substantially on an operative axis extending through the pivot mounting 39 so that the rotational lever 30 is not urged into the second position. Cutting reaction forces are also transmitted by way of the projection portion 46*a* to the projection 24 and the projection 28.

As can be seen in particular from FIG. 4, it is easily possible in the second position of the rotational lever 30 in which the locking member 40 is also in the second position and the nose 42 is not engaging into the recess 48 but rather releases the blade 8, for it to be removed from the housing 2, in particular by being pulled out of same, for example downwardly in the direction of the projection 24 in relation to FIG. 4.

Figure 5:
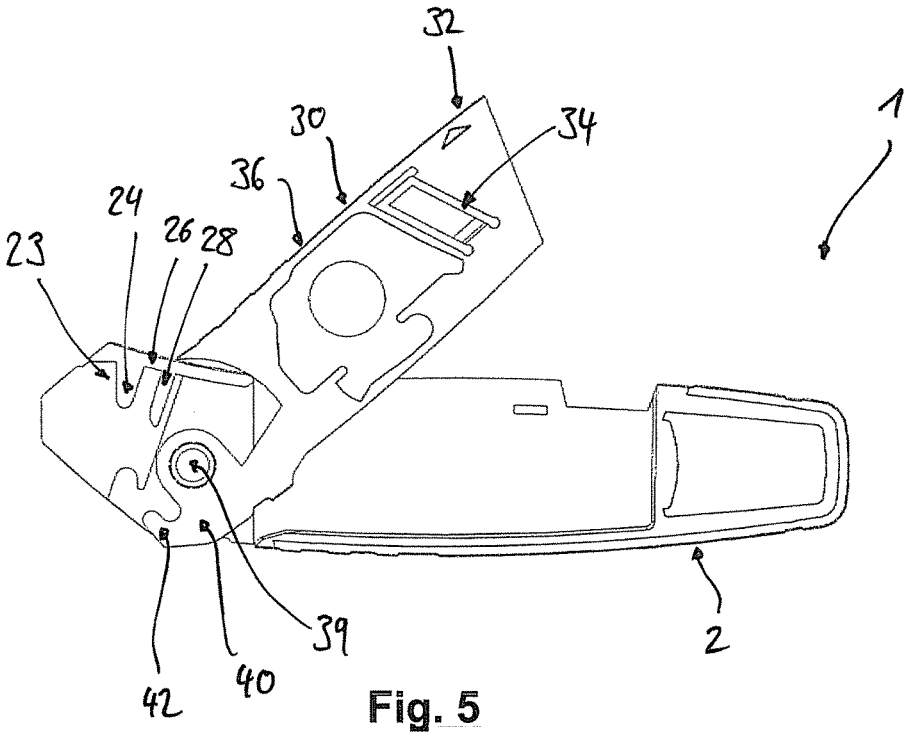
FIG. 5 shows the cutting tool of FIG. 4 with blade removed.
Figure 6:
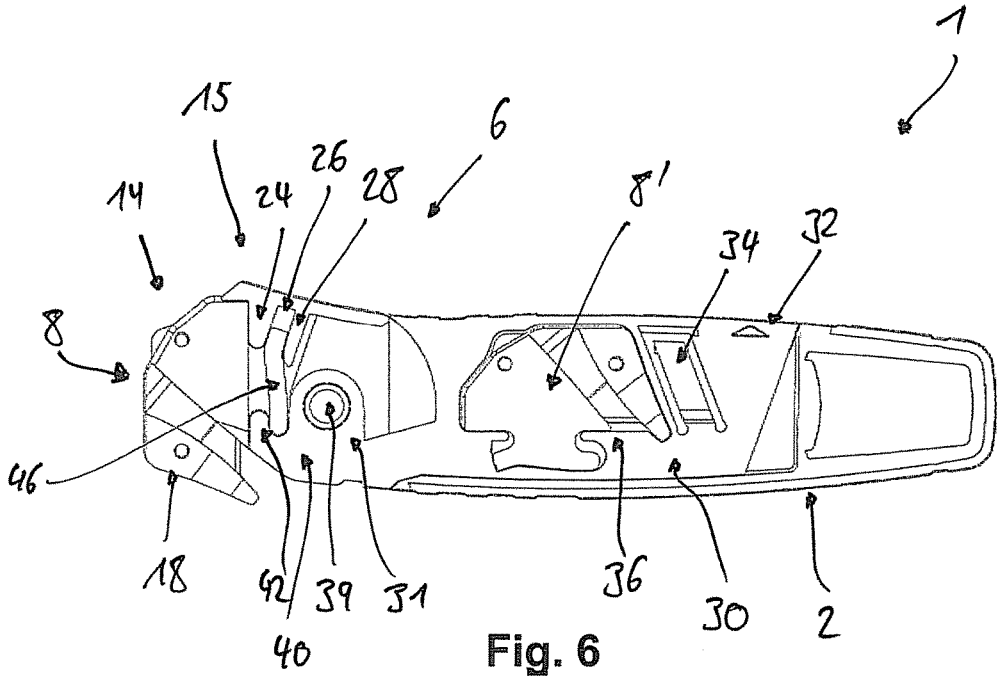
FIG. 6 shows the cutting tool of FIG. 4 with the rotational lever pivoted into the first position.
Figure 7:
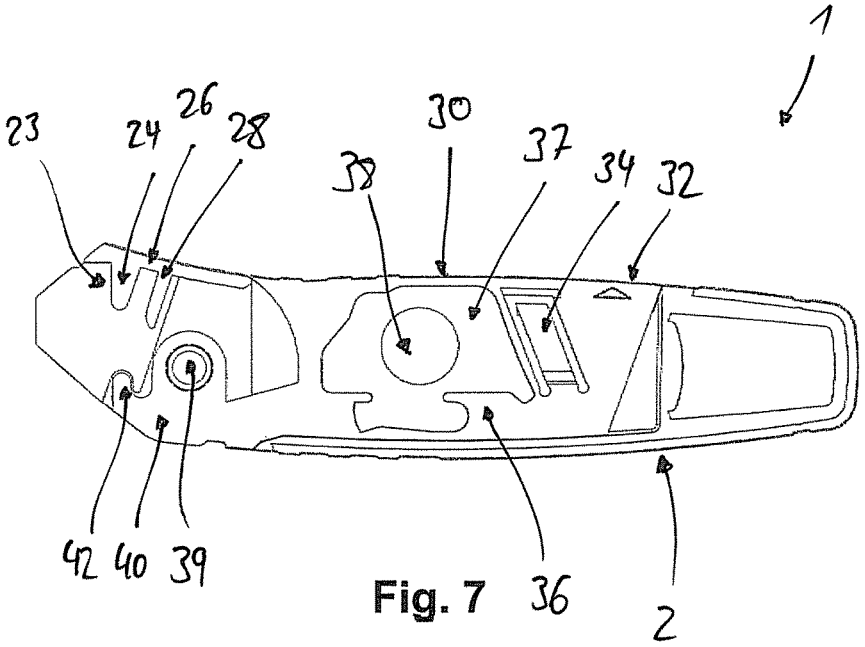
FIG. 7 shows the cutting tool of FIG. 5 with the rotational lever pivoted into the first position.
Figure 8:
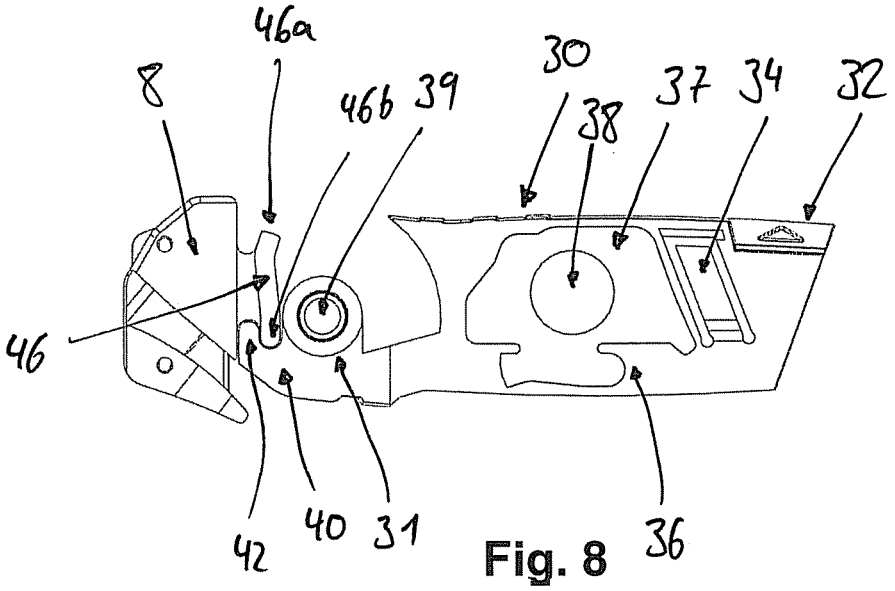
FIG. 8 shows a side view of the rotational lever with interchangeable blade.

To insert a blade 8 into the cutting tool 1 or into the housing 2, the procedure is accordingly to be as follows: firstly the rotational lever 30 is to be moved into the second position (as shown in FIGS. 4 and 5) and then a blade is to be fitted into the holding portion 6 of the housing 2 so that the projection portion 46*a* engages into the opening 26, the projection 24 engages into the opening 44 and the flat abutment 45 bears against the abutment 23. The rotational lever 30 is then to be pressed down or moved into the first position whereby the locking member 40 is also moved into the first position and the nose 42 engages into the opening 48. The rotational lever 30, the locking member 40 and the nose 42 are then in the position as shown in FIGS. 6 and 7.

The present embodiment only shows a cutting tool 1 in which the cutting edge 12 is oriented perpendicularly to the longitudinal axis A of the cutting tool 1 and which has a guide passage 22 for material to be severed. It is to be appreciated however that the invention is not limited to such cutting tools but rather can also be used in relation to cutting tools with blades having a cutting edge which extends substantially parallel to the longitudinal axis A and in which the blade tip or the cutting edge tip is exposed.

The invention claimed is:

1. A cutting tool comprising:

a housing including a holding portion, a gripping portion, and a plurality of positive-locking elements at the holding portion;

a rotational lever mounted pivotably to the housing;

a blade arranged at the holding portion of the housing, the blade including a cutting edge and a plurality of positive-locking elements; and a locking member coupled with the rotational lever and configured to lock the blade to the housing, the locking member reciprocatingly movable between a first position in which the blade is locked and a second position in which the blade is released, and the locking member having a positive-locking element configured to cooperate with the positive-locking elements of the housing to lock the blade in a given position to the housing, wherein the positive-locking elements of the blade further cooperate with the positive-locking elements of the housing and the locking member in such a way that substantially no moments are introduced into the rotational lever by virtue of cutting reaction force, wherein the cutting edge of the blade faces rearwardly and towards the gripping portion of the housing, and wherein the holding portion includes one side where the positive-locking elements of the holding portion are provided and another side located in opposite relationship to the one side, the another side being where the cutting edge of the blade is located.

2. The cutting tool of claim 1 wherein the blade includes an opening, and the positive-locking element of the locking member is a nose configured to engage the opening for locking the blade.

3. The cutting tool of claim 1 wherein the blade includes an opening, and the positive-locking elements of the housing include at least one projection configured to engage the opening.

4. The cutting tool of claim 1 wherein the positive-locking elements of the housing include an abutment, and the blade includes a flat abutment that bears against the abutment of the housing so that cutting reaction forces are transmitted into the housing.

5. The cutting tool of claim 1 wherein the cutting edge is oriented substantially perpendicularly to a longitudinal axis (A) of the cutting tool.

6. A method of changing an interchangeable blade of a cutting tool, the method comprising:

providing the cutting tool of claim 1;

moving the locking member arranged on the rotational lever into the second position to release the blade;

pulling the blade out of the housing of the cutting tool;

inserting a second blade into the housing; and moving the locking member into the first position to lock the second blade in a given position to the housing, wherein the movement of the locking member includes a rotation of the locking member and the rotational lever, and wherein the second blade further cooperates with the positive-locking elements of the housing and the locking member in such a way that substantially no moments are introduced into the rotational lever by virtue of cutting reaction force applied to the second blade.

7. The cutting tool of claim 1, wherein the blade includes a blade head and a blade foot, and the blade head includes a cutting part made of blade steel which is at least partly engagingly fitted into a plastic body in the region of the blade head, the plastic body having a guide portion forming a guide passage for material to be cut.

8. The cutting tool of claim 1, wherein the rotational lever includes a blade storage member for receiving a substitute blade, which can be removed from the blade storage member when the locking member and the rotational lever are moved to the second position, the substitute blade being configured to replace the blade.

* * * * *